US011371376B2

(12) United States Patent
Barker et al.

(10) Patent No.: US 11,371,376 B2
(45) **Date of Patent: *Jun. 28, 2022**

(54) SEALING SURFACE FOR CERAMIC MATRIX COMPOSITE BLADE OUTER AIR SEAL

(71) Applicant: Raytheon Technologies Corporation, Farmington, CT (US)

(72) Inventors: William M. Barker, North Andover, MA (US); Thomas E. Clark, Sanford, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 80 days.

This patent is subject to a terminal disclaimer.

(21) Appl. No.: 16/795,738

(22) Filed: Feb. 20, 2020

(65) Prior Publication Data

US 2020/0300106 A1 Sep. 24, 2020

Related U.S. Application Data

(63) Continuation of application No. 16/050,625, filed on Jul. 31, 2018, now Pat. No. 10,633,995.

(51) Int. Cl.
*F01D 11/00* (2006.01)
*F01D 11/08* (2006.01)

(52) U.S. Cl.
CPC ..... *F01D 11/005* (2013.01); *F01D 11/08* (2013.01); *F05D 2220/323* (2013.01); (Continued)

(58) Field of Classification Search
CPC ..... F01D 5/20; F01D 9/023; F01D 11/001; F01D 11/005; F01D 11/006; F01D 11/08; (Continued)

(56) References Cited

U.S. PATENT DOCUMENTS 5,074,748 A 12/1991 Hagle
5,480,162 A 1/1996 Beeman, Jr.
(Continued)

FOREIGN PATENT DOCUMENTS

EP 2990699 A1 3/2016
EP 3085901 A1 10/2016
(Continued)

OTHER PUBLICATIONS

European Search Report for EP Application No. 19189443.5 dated Jan. 13, 2020.

*Primary Examiner* — Brian P Wolcott
*Assistant Examiner* — Sang K Kim
(74) *Attorney, Agent, or Firm* — Carlson, Gaskey & Olds, P.C.

(57) ABSTRACT

A gas turbine engine includes a turbine section having a turbine rotor and at least one blade extending outwardly of the turbine rotor. The turbine rotor rotates about an axis of rotation. A blade outer air seal is positioned radially outward of the at least one blade. The blade outer air seal has an axially forward hook and an axially aft hook supported to static structure. An axial seal is attached to static structure forward of the forward hook, and has a sealing portion extending in an aft direction. A sealing surface member is positioned intermediate an aft end of the axial seal and a forward end of the forward hook to provide a sealing surface for sealing between the seal and the blade outer air seal.

14 Claims, 6 Drawing Sheets

(52) U.S. Cl.
CPC ..... *F05D 2240/11* (2013.01); *F05D 2240/55* (2013.01); *F05D 2300/17* (2013.01); *F05D 2300/6033* (2013.01)

(58) Field of Classification Search
CPC ..... F05D 2220/323; F05D 2240/11; F05D 2240/55; F05D 2300/17; F05D 2300/6033
See application file for complete search history.

(56) References Cited

U.S. PATENT DOCUMENTS

| | | | | |
|---|---|---|---|---|
| 5,609,469 | A | 3/1997 | Worley et al. | |
| 6,076,835 | A * | 6/2000 | Ress | F01D 11/005 277/637 |
| 6,170,831 | B1 | 1/2001 | Bouchard | |
| 9,863,538 | B2 | 1/2018 | Duguay | |
| 9,963,990 | B2 | 5/2018 | Vetters et al. | |
| 10,400,896 | B2 | 9/2019 | Davis | |
| 2016/0003080 | A1* | 1/2016 | Mcgarrah | F01D 11/005 415/173.1 |
| 2016/0047258 | A1* | 2/2016 | Hall | F01D 11/005 415/1 |
| 2016/0061330 | A1* | 3/2016 | Davis | F16J 15/328 277/355 |
| 2016/0298475 | A1* | 10/2016 | Tatman | F01D 11/005 |
| 2019/0292927 | A1 | 9/2019 | Barker | |
| 2020/0063587 | A1* | 2/2020 | Clark | F01D 25/246 |

FOREIGN PATENT DOCUMENTS

| | | | |
|---|---|---|---|
| EP | 3219924 | A1 | 9/2017 |
| EP | 3315731 | A1 | 5/2018 |
| WO | 2015/002673 | A2 | 1/2015 |

* cited by examiner

SEALING SURFACE FOR CERAMIC MATRIX COMPOSITE BLADE OUTER AIR SEAL

CROSS REFERENCE TO RELATED APPLICATION

This application is a continuation of U.S. patent application Ser. No. 16/050,625 filed on Jul. 31, 2018, now U.S. Pat. No. 10,633,995 granted on Apr. 28, 2020.

BACKGROUND

This application relates to a sealing surface associated with a forward hook in a ceramic matrix composite blade outer air seal.

Gas turbine engines are known and typically include a fan delivering air into a compressor. The air is compressed and delivered into a combustion section where it is mixed with fuel and ignited. Products of the combustion pass downstream over turbine rotors, driving them to rotate.

It is desirable to maximize the percentage of the products of combustion that pass over turbine blades on the turbine rotors. Thus, it is known to provide a blade outer air seal ("BOAS") radially outwardly of the turbine blade.

To further maximize the percentage of the products of combustion directed across the turbine blades, seals are associated with the blade outer air seal. The seals prevent leakage radially outwardly around the BOAS.

It has been proposed to form BOAS of ceramic matrix composite ("CMC") materials.

SUMMARY

In a featured embodiment, a gas turbine engine includes a turbine section having a turbine rotor and at least one blade extending outwardly of the turbine rotor. The turbine rotor rotates about an axis of rotation. A blade outer air seal is positioned radially outward of the at least one blade. The blade outer air seal has an axially forward hook and an axially aft hook supported to static structure. An axial seal is attached to static structure forward of the forward hook, and has a sealing portion extending in an aft direction. A sealing surface member is positioned intermediate an aft end of the axial seal and a forward end of the forward hook to provide a sealing surface for sealing between the seal and the blade outer air seal.

In another embodiment according to the previous embodiment, the blade outer air seal is formed of ceramic matrix composite materials.

In another embodiment according to any of the previous embodiments, the forward hook has a curved portion extending from a blade outer air seal body into the forward hook. The seal is radially aligned with the curved portion such that the sealing surface member provides a sealing surface in place of the curved portion.

In another embodiment according to any of the previous embodiments, the sealing surface member has a generally radially extending portion extending radially inwardly to a curved sealing surface member portion curving in a forward direction relative to the generally radially extending portion.

In another embodiment according to any of the previous embodiments, the sealing surface portion is formed of one of a ceramic matrix composite material or a cobalt based alloy.

In another embodiment according to any of the previous embodiments, the seal is a bristle seal having bristles with an aft end in contact with the sealing surface member.

In another embodiment according to any of the previous embodiments, the bristles are formed of a cobalt alloy or cobalt steel.

In another embodiment according to any of the previous embodiments, the seal is supported on a vane support which is located forward of the blade.

In another embodiment according to any of the previous embodiments, the seal has a radially inwardly extending ledge.

In another embodiment according to any of the previous embodiments, the radially inwardly extending ledge has a radially innermost extent which is radially inward of a radially outermost extent of a forward end of the curved portion of the seal surface member.

In another embodiment according to any of the previous embodiments, the radially inwardly extending ledge has a radially innermost extent which is radially outward of a radially outermost extent of a forward end of the curved portion of the seal surface member.

In another embodiment according to any of the previous embodiments, an aft extending tab extends from the generally radially extending portion of the sealing surface member and is positioned radially between the forward hook of the blade outer air seal and the static structure.

In another embodiment according to any of the previous embodiments, the sealing surface member has circumferentially spaced tabs to prevent rotation relative to the static surface.

In another embodiment according to any of the previous embodiments, the forward hook has a curved portion extending from a blade outer air seal body into the forward hook. The seal is radially aligned with the curved portion such that the sealing surface member provides a sealing surface in place of the curved portion.

In another embodiment according to any of the previous embodiments, the sealing surface member has a generally radially extending portion extending radially inwardly to a curved sealing surface member portion curving in a forward direction relative to the generally radially extending portion.

In another embodiment according to any of the previous embodiments, the seal is a bristle seal having bristles with an aft end in contact with the sealing surface member.

In another embodiment according to any of the previous embodiments, the seal has a radially inwardly extending ledge.

In another embodiment according to any of the previous embodiments, the radially inwardly extending ledge has a radially innermost extent which is radially inward of a radially outermost extent of a forward end of the curved portion of the seal surface member.

In another embodiment according to any of the previous embodiments, the radially inwardly extending ledge has a radially innermost extent which is radially outward of a radially outermost extent of a forward end of the curved portion of the seal surface member.

In another embodiment according to any of the previous embodiments, an aft extending tab extends from the generally radially extending portion of the sealing surface member and is positioned radially between the forward hook of the blade outer air seal and the static structure.

These and other features may be best understood from the following drawings and specification.

DETAILED DESCRIPTION

Figure 1:
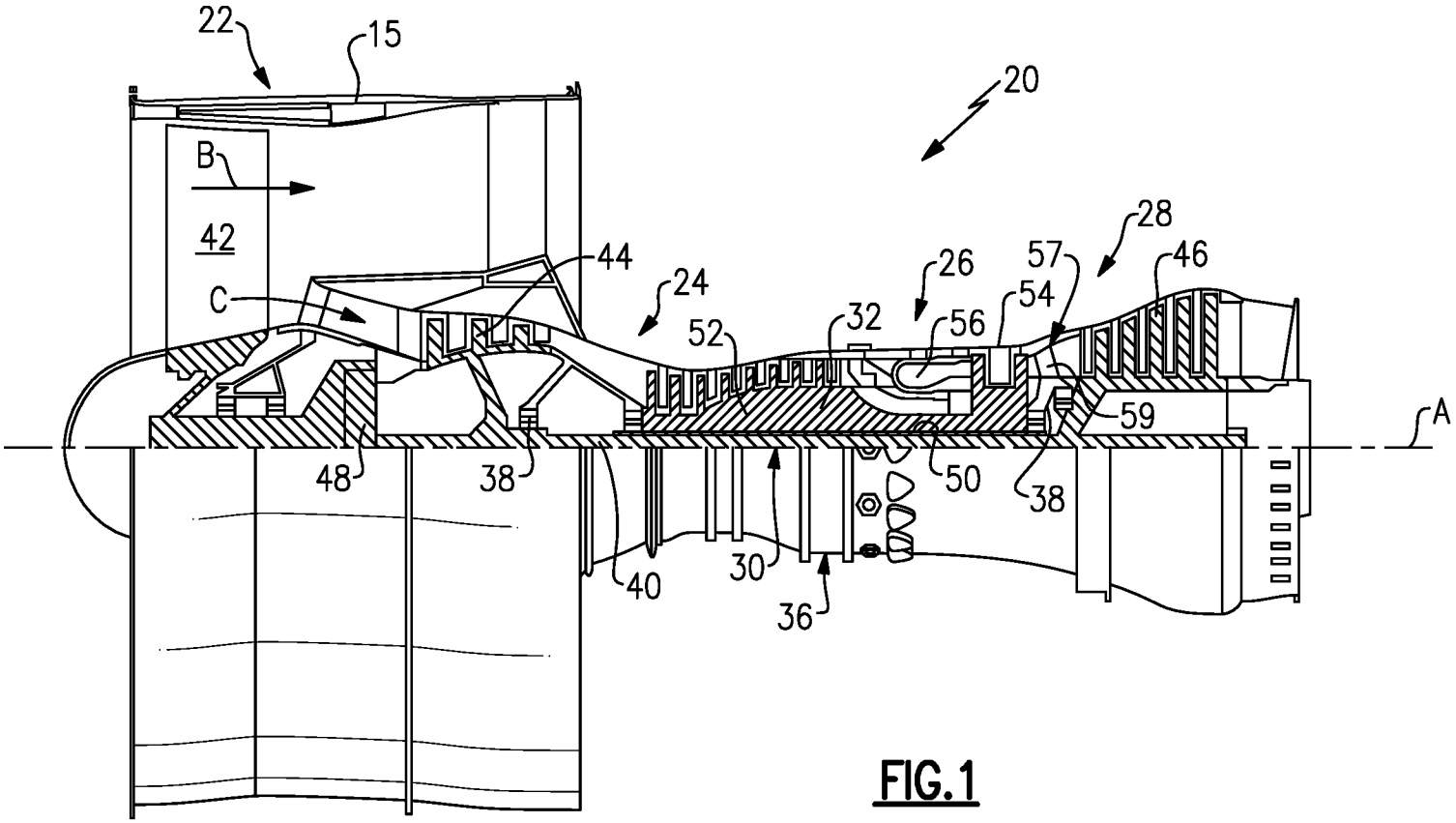
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 meters/second).

Figure 2:
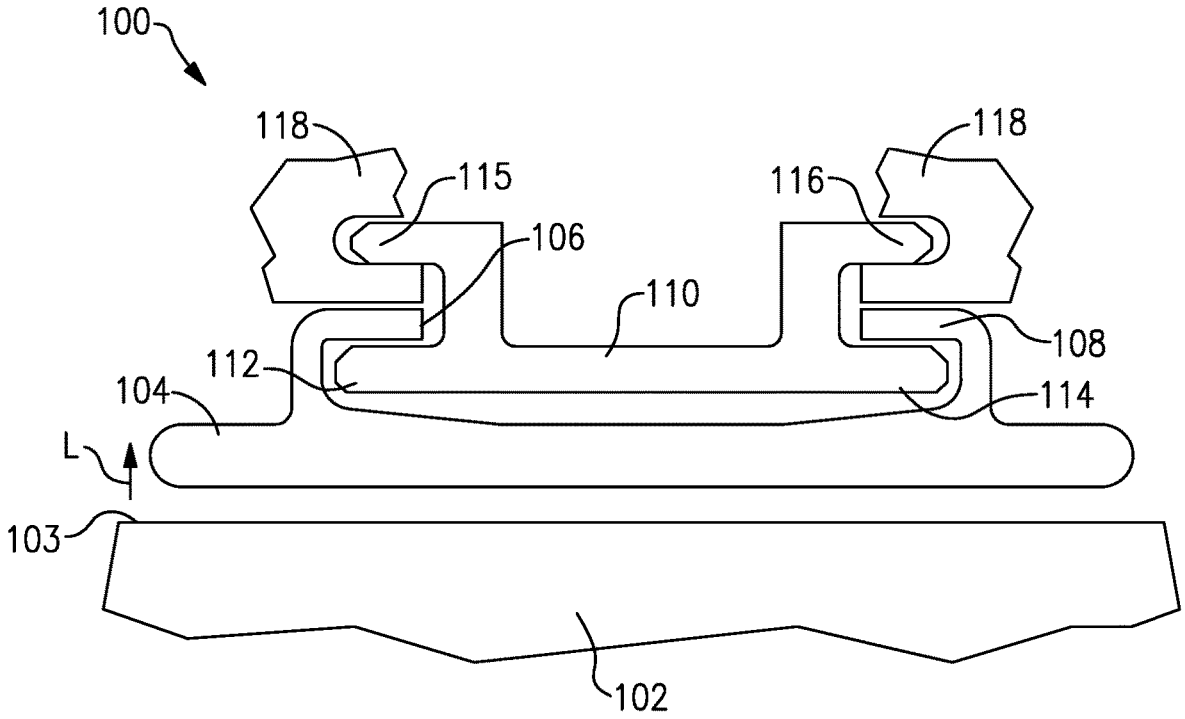
FIG.2 Prior Art
FIG. 2 is a schematic view of a known turbine section.

FIG. 2 shows a turbine section 100. A turbine blade 102 has a radially outer extent 103. A BOAS 104 is positioned radially outward of the tip 103. The BOAS 104 has a forward hook 106 and an aft hook 108. A support or attachment block 110 has surfaces 112 and 114 supporting the hooks 106 and 108. The attachment block 110 further has forward mount portion 115 and aft mount portion 116 mounting the attachment block and, hence the BOAS 104, into static structure 118.

The structure as generally shown in FIG. 2 is known. It is desirable to prevent leakage at the forward end from moving radially outwardly in the direction of the arrow L.

Figure 3:
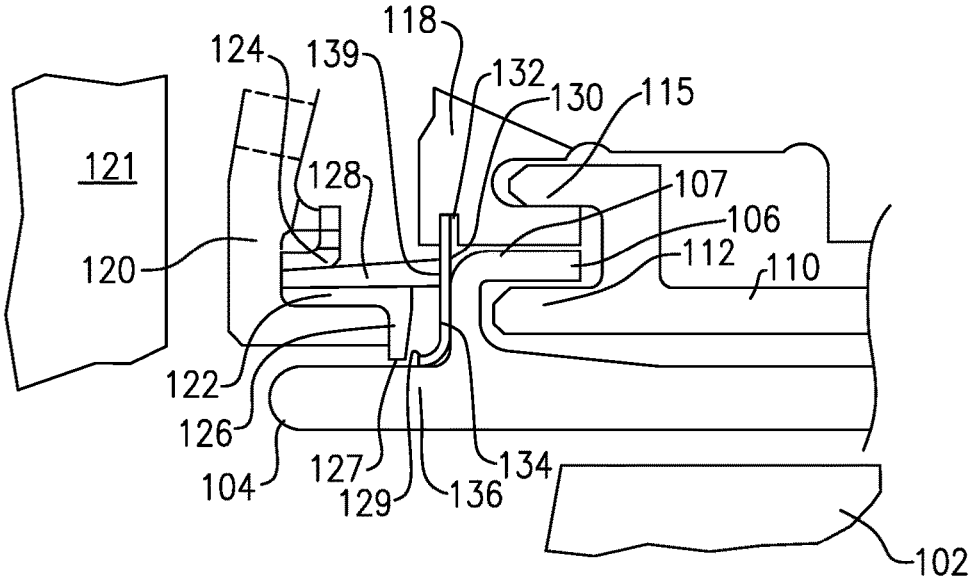
FIG. 3 shows an area of a forward hook.

FIG. 3 shows an assembly according to one embodiment of this disclosure. A vane support 120 is attached to a static vane 121, shown schematically, and axially forward of the blade 102. A seal 122 is mounted on the vane support 120. An outer seal attachment portion 124 is shown, as is an inwardly extending lip 126. A seal 128 extends in an aft direction from the vane support 120 and provides a seal against hook 106.

It has been proposed to form BOAS 104 of CMC materials. It has further been proposed to utilize a bristle seal for the seal 128. Various steels are being proposed for the bristle seal 128. In one proposal, the bristles of seal 128 may be formed of cobalt based materials including Haynes 25 or other cobalt alloys or steels, as examples. Such materials may raise concerns if sealing against a hook 106 formed of CMC materials. (The CMC materials may also be formed from laminates.) Also, the CMC materials may be monolithic CMCs. Also, the BOAS materials may be monolithic ceramics.

Thus, a sealing surface member 130 is positioned between an aft end 139 of the seal 128 and the hook 106. The sealing surface member 130 provides a surface to ensure a good seal. As can be appreciated from FIG. 3, the hook 106 has a curved portion 107 in the approximate radial extent of the bristle 128. Thus, a complex, or insufficiently tall, sealing surface might be experienced in the absence of the additional sealing surface member 130. Sealing surface member 130 may be formed of an appropriate wear resistant material such as Haynes 242, a cobalt based alloy of a ceramic matrix composite material having sufficient compliance for the intended application.

A notch 132 in static structure 118 secures the sealing surface member 130. In an embodiment, the sealing surface member 130 has a radially inwardly extending straight portion 134 and a hook portion 136 that curves in a forward direction from said straight portion 134 such that the overall shape of the sealing surface member 130 is generally a J-shape. As can be seen, the seal 128 contacts the radially inwardly extending straight portion 134, and the hook portion 136 is radially inward of the seal.

In this embodiment, the inwardly extending flange 126 has a radially innermost extent 127, which is radially inward of a radially outermost extent 129 of the hook 136 at its forward most end. This provides additional support.

Figure 4:
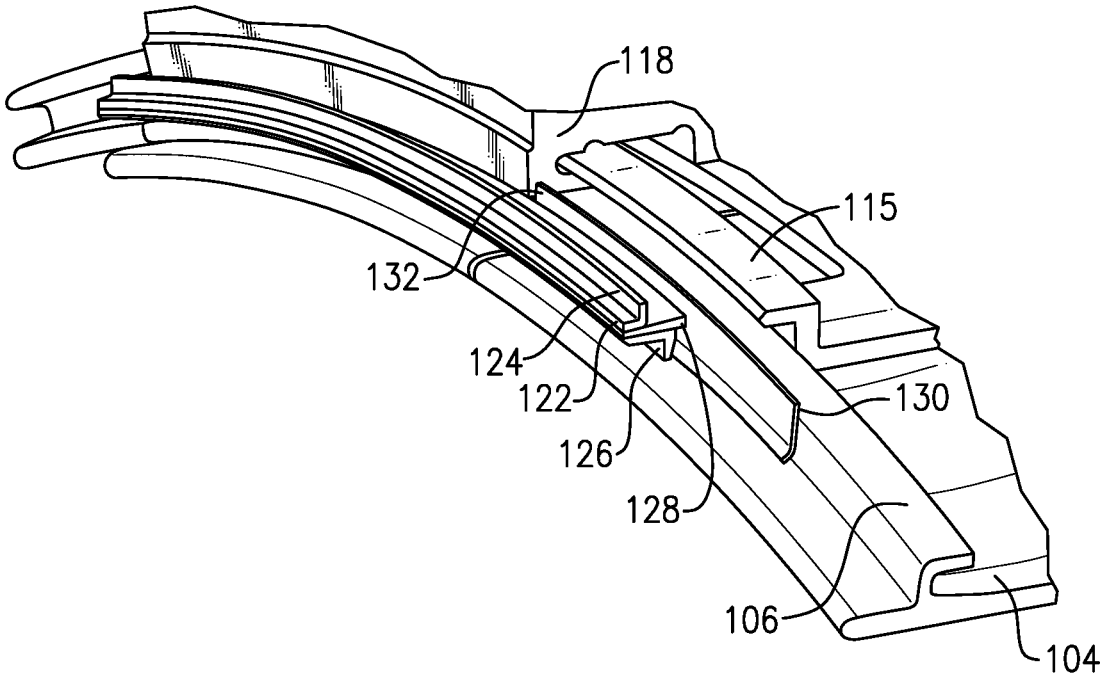
FIG. 4 shows a disclosed assembly in a blade outer air seal.

As shown in FIG. 4, the sealing surface member 130 sits between the hook 106 and the bristle seal 128. Moreover, the notch 132 provides support to secure the sealing surface member 130.

Figure 5:
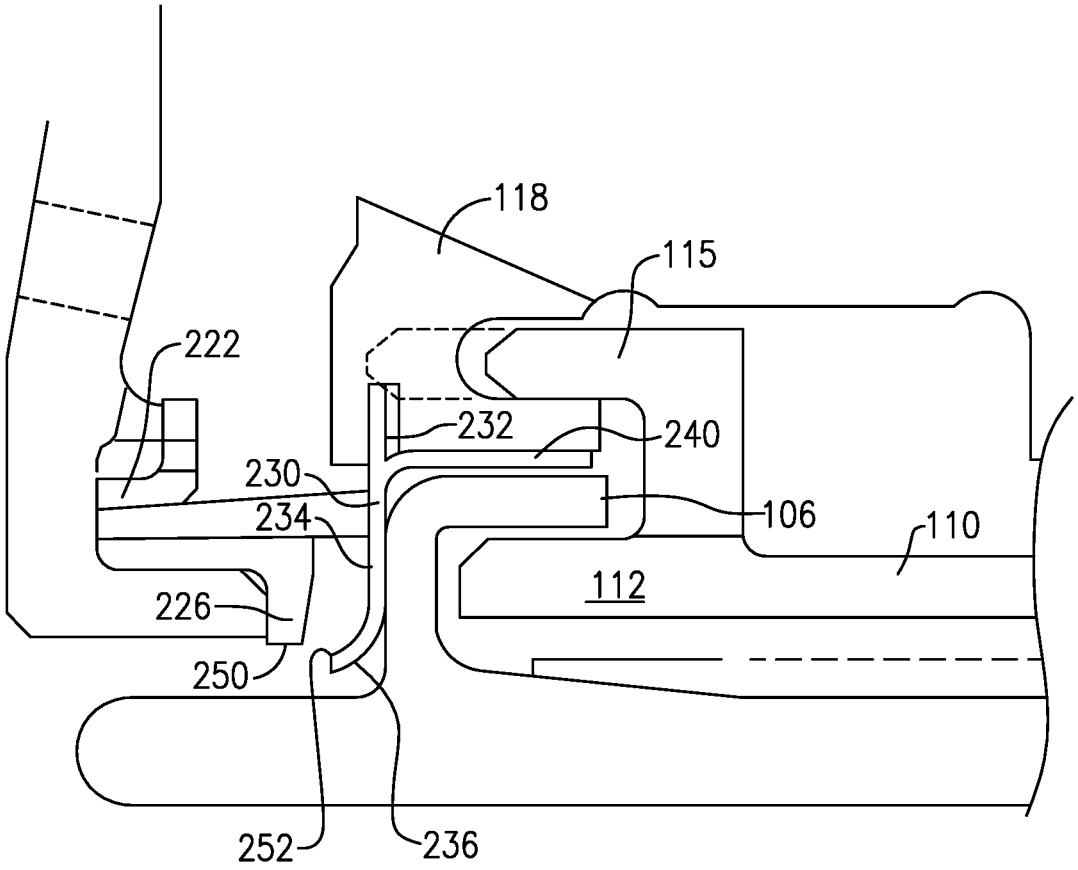
FIG. 5 shows an alternative embodiment.

FIG. 5 shows an alternative embodiment. In the alternative embodiment, the inwardly extending flange 226 of the seal 222 has a radially inner end 250, which is radially outward of a radially outermost point 252 of the forward most end of the hook 236 of the sealing surface member 230.

Sealing surface member 230 has a more complex tab structure 232, as will be explained below. In addition, there is a tab 240 extending in an aft direction from the straight portion 234, and positioned radially intermediate the hook 106 and a portion of the support 118, which is radially inward of the hook portion 115 of the attachment block 110.

Figure 6:
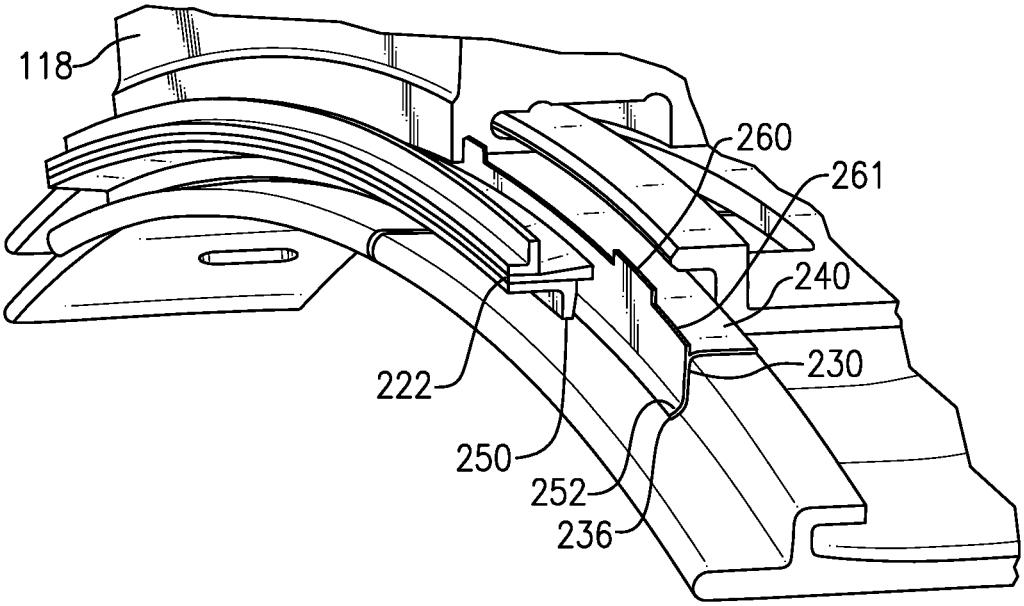
FIG. 6 shows an assembly of the alternative embodiment.

As shown in FIG. 6, the sealing surface member 230 has circumferentially intermediate tabs 260 extending outwardly of portions 261.

Figure 7:
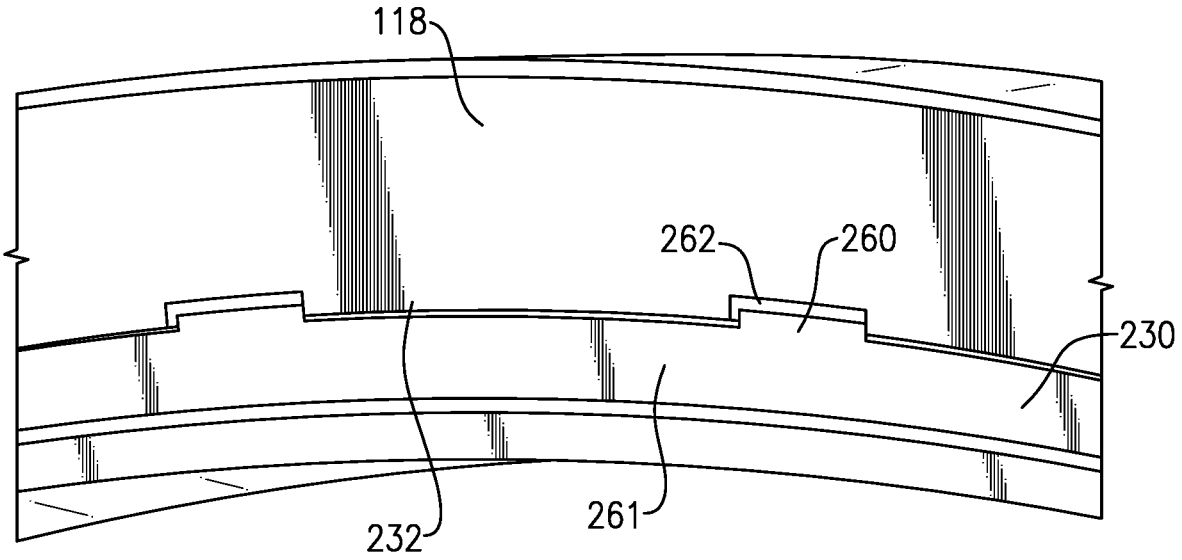
FIG. 7 shows a detail of the FIG. 6 embodiment.

FIG. 7 shows notch 232 in static structure 118 to receive portion 261 from sealing surface member 230. Tabs 260 sit in anti-rotation notches 262 to prevent rotation of sealing surface member 230.

While the sealing surface members are particularly valuable when utilized in combination with CMC BOAS, they may have application in metallic BOAS, or BOAS formed of other materials.

Although an embodiment of this invention has been disclosed, a worker of ordinary skill in this art would recognize that certain modifications would come within the scope of this disclosure. For that reason, the following claims should be studied to determine the true scope and content of this disclosure.

What is claimed is:

1. A gas turbine engine comprising:

a turbine section having a turbine rotor and at least one blade extending outwardly of said turbine rotor, said turbine rotor rotating about an axis of rotation;

a blade outer air seal positioned radially outward of said at least one blade;

a seal attached to static structure, and having a sealing portion extending towards a surface on said blade outer air seal;

a sealing surface member positioned intermediate an end of said seal and said surface on said blade outer air seal to provide a sealing surface for sealing between said seal and said blade outer air seal;

wherein said blade outer air seal is formed of ceramic matrix composite materials;

wherein said sealing surface member has a generally radially inwardly extending portion extending radially inwardly to a curved sealing surface member portion curving relative to said generally radially inwardly extending portion, and said end of said seal contacting said radially inwardly extending portion; and wherein said surface is a curved portion of the blade outer air seal, and said seal being radially aligned with said curved portion such that said sealing surface member provides a sealing surface in place of said curved portion.

2. The gas turbine engine as set forth in claim 1, wherein said sealing surface member is formed of one of a ceramic matrix composite material or a cobalt based alloy.

3. The gas turbine engine as set forth in claim 1, wherein said seal is a bristle seal having bristles with an end in contact with said sealing surface member.

4. The gas turbine engine as set forth in claim 3, wherein said bristles are formed of a cobalt alloy or cobalt steel.

5. The gas turbine engine as set forth in claim 3, wherein said sealing surface member is formed of one of a ceramic matrix composite material or a cobalt based alloy.

6. The gas turbine engine as set forth in claim 1, wherein said sealing surface member is formed of one of a ceramic matrix composite material or a cobalt based alloy.

7. The gas turbine engine as set forth in claim 1, wherein said seal is supported on a vane support.

8. A gas turbine engine comprising:

a turbine section having a turbine rotor and at least one blade extending outwardly of said turbine rotor, said turbine rotor rotating about an axis of rotation;

a blade outer air seal positioned radially outward of said at least one blade;

a seal attached to static structure, and having a sealing portion extending towards a surface on said blade outer air seal;

a sealing surface member positioned intermediate an end of said seal and said surface on said blade outer air seal to provide a sealing surface for sealing between said seal and said blade outer air seal;

wherein said blade outer air seal is formed of ceramic matrix composite materials; and wherein said seal is a bristle seal having bristles with an end in contact with said sealing surface member.

9. The gas turbine engine as set forth in claim 8, wherein said surface is a curved portion of the blade outer air seal, and said seal being radially aligned with said curved portion such that said sealing surface member provides a sealing surface in place of said curved portion.

10. The gas turbine engine as set forth in claim 8, wherein said bristles are formed of a cobalt alloy or cobalt steel.

11. The gas turbine engine as set forth in claim 10, wherein said seal is supported on a vane support.

12. The gas turbine engine as set forth in claim 8, wherein said seal is supported on a vane support.

13. The gas turbine engine as set forth in claim 8, wherein said surface is a curved portion of the blade outer air seal, and said seal being radially aligned with said curved portion such that said sealing surface member provides a sealing surface in place of said curved portion.

14. The gas turbine engine as set forth in claim 8, wherein said sealing surface member has a generally radially inwardly extending portion extending radially inwardly to a curved sealing surface member portion curving in a forward direction relative to said generally radially inwardly extending portion.

* * * * *